United States Patent [19]

De Silva et al.

[11] Patent Number: 4,932,822

[45] Date of Patent: Jun. 12, 1990

[54] PRESS AND TRANSFER TOOL

[75] Inventors: Manikwadura G. De Silva, Ruislip; Robert A. Owen, Faringdon, both of United Kingdom

[73] Assignee: CMB Packaging (UK) Ltd., United Kingdom

[21] Appl. No.: 380,417

[22] Filed: Jul. 17, 1989

[30] Foreign Application Priority Data

Jul. 15, 1988 [GB] United Kingdom ..... 8816380

[51] Int. Cl.[5] ..... B21D 51/44

[52] U.S. Cl. ..... 413/66; 413/14; 72/405

[58] Field of Search ..... 72/405, 346, 356, 333–336; 413/52, 45, 8, 70, 66, 14

[56] References Cited

U.S. PATENT DOCUMENTS

| | | | |
|---|---|---|---|
| 119,979 | 10/1871 | Garrick | 72/336 |
| 4,026,226 | 5/1977 | Hahn | 72/405 |
| 4,568,230 | 2/1986 | Brown | 413/14 |
| 4,723,882 | 2/1988 | Wissman | 72/405 |

*Primary Examiner*—Daniel C. Crane

*Attorney, Agent, or Firm*—Diller, Ramik & Wight

[57] ABSTRACT

A single action press having a bed 14, a ram 11 movable towards and away from the bed, a first progression of tool pairs 17*a*, 17*b* arranged along the bed, a conveying mechanism 18 to transfer a component from each tool pair to the next, and a second progression of tool pairs arranged to extend from front to back of the press bed, is provided with a bridge 20 which supports the lower tools of the second progression at a level above the conveying mechanism.

37 Claims, 12 Drawing Sheets

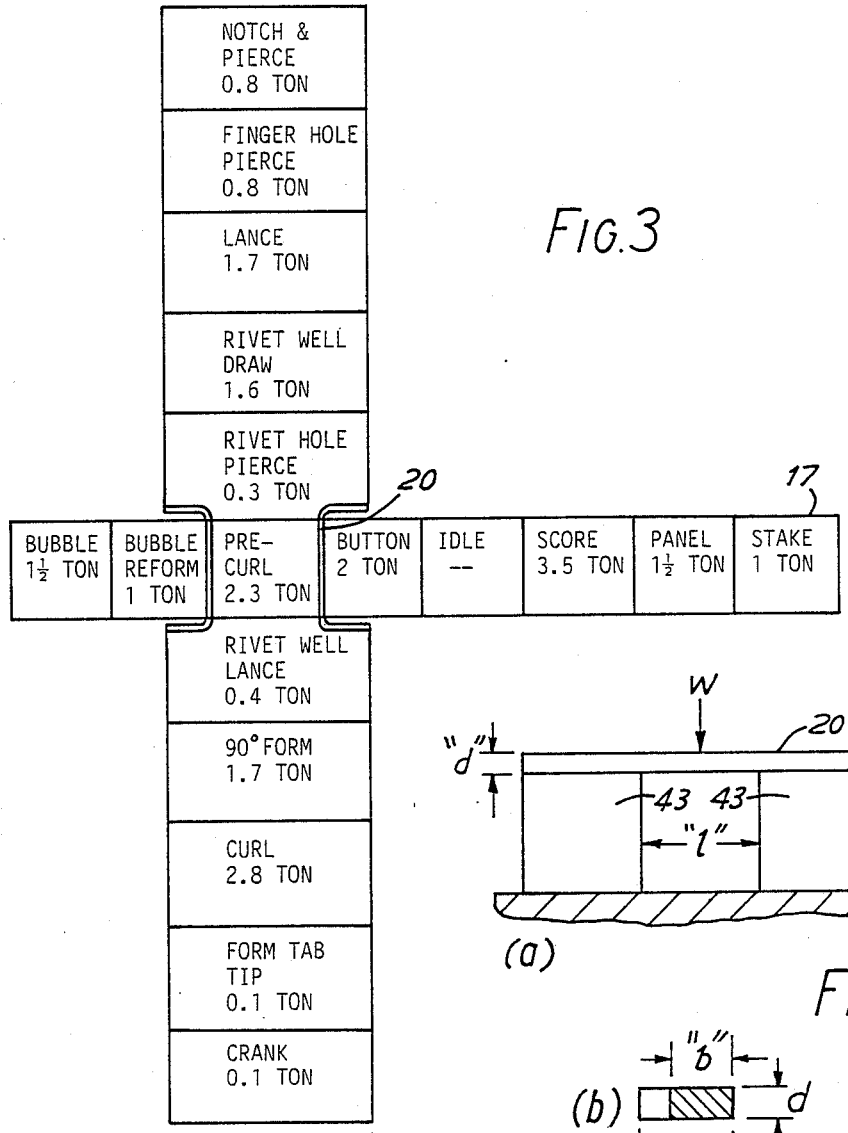
FIG. 3
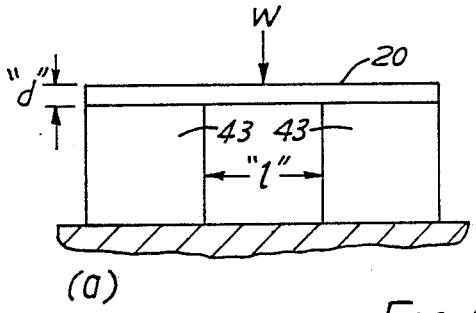
FIG. 4
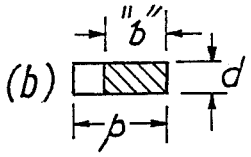

PRESS AND TRANSFER TOOL

BACKGROUND OF THE INVENTION

This invention relates to a press having at least two progressions of transfer tooling and more particularly but not exclusively to a press having a first progression of tools to form a tear open can end and a second progression of tools to make a pull tab which is subsequently rivetted to the can end.

DESCRIPTION OF RELATED ART

U.S. Pat. No. 4,026,226 (Earn/American Can Co.) describes and claims a tool for making tear open can ends having a pull tab. The press comprises a top platen connected by frame members to a bottom platen and an inner platen supported by the frame for reciprocal motion between the top platen and bottom platen. A tab forming progression tool is mounted between the top platen and topside of the inner platen: A progression of can end forming tools is mounted between the inner platen and top side of the bottom platen; so that as the inner platen moves towards the top platen the tab forming tools produce tabs and as the inner platen moves towards the bottom platen the end forming tools produce can ends. The tabs are formed from a strip of metal which, after tab forming, is bent back to cross the progression of can end forming tools at a tab fixing station. In the embodiment described the progression of end forming tools is laid along a centre line of the bottom platen and underside of the inner platen and the tab forming tool is laid upon the topside of the inner platen to cross at right angles the centre of the centre line of the end forming tool progression. Therefore both tab forming loads and end forming loads are sequentially received at the centre of the inner platen as work proceeds to impose a cycle of bending and reverse bending loads on the inner platen at a location distant from the guide frame members.

U.S. Pat. Nos. 4,568,230 and 4,640,116 (Brown/Dayton Reliable Tool Manufacturing Co.) describe a press and tools for producing can ends having a ring pull tab. The press has a rectangular bed, a crown, and slide or ram reciprocably driven between the bed and crown. The bed and underside of the slide are fitted with cooperating pairs of multi station end forming tools arranged progressively and centred on a line extending from side to side of the press. Two multi station tab forming tool parts are fitted to the bed and slide and arranged progressively on a line from front to back of the press which crosses the line of the can end forming tools at right angles at the centre of the can end tooling. The tab forming tools are in the form of a first part progression extending to the front of slide and bed and a second part progression extending to the back of the slide and bed so that the off-centre load that could arise from a single upper tab tool fixed to one side of the slide is avoided by the weight of the first part progression balancing the weight of the second part progression. The tab tooling is fed with a strip of metal which is conveyed across the centre line of the can end tools by a bridge so that no work is done on the tab metal or can ends at the centre of the bed or slide. Consequently the upper tab tools are spaced a significant distance from the centre of the slide at which position they exert a bending moment, on the slide, aggravated by the rapid reciprocation of the ram and delivered to the slide guides as the connecting rods swing from an approach angle to a return angle during each press cycle.

Both Earn and Brown chose to locate their tab tools at the centre of their slide or platten. Whilst this location appears to provide symmetrical loading of the ram or slide, in practice, the later stages of can end forming (e.g. scoring and rivet staking) and the later stages of tab forming require relatively high loads so that the static balance arising from symmetrical location of the can end progression tools relative to the tab forming progression may not be ideal because out of balance work loads will exert tilting forces on the ram or slide to exert wear forces on guides which guide the ram or slide motion.

SUMMARY OF THE INVENTION

This invention seeks to provide (i) improved usage of the ram and bed area by means of compact tab tooling under the ram; and (ii) improved distribution of the tools on the bed/slide areas to reduce the unbalancing offset of off-centre tool loads.

Accordingly, this invention provides a press of a kind having a bed, a ram movable towards and away from said bed, a first progression of tool pairs arranged along the bed each comprising an upper tool fixed to the underside of the ram and a lower tool fixed to the bed; conveying means to transfer a component from each tool pair to the next; and a second progression of tool pairs comprising upper tools fixed to the underside of the ram and lower tools supported by the bed and arranged to progressively shape articles from an elongate strip of material which is conveyed across said conveying means on a bridge, characterised in that, a lower tool of a pair of said second progression of tool pairs is supported by the bridge which is in turn supported on the bed.

A portion of the bridge spanning the conveying means is able to support at least one lower tool cooperable with its complementary upper tool so that the ram area over the conveyor is used and any overhang of the compact length of tab tooling progression, beyond the slide, is minimised.

The bridge may, if desired, cross the conveying means on a line away from the centre of the ram.

In one embodiment the bridge crosses the conveying means on a line perpendicular to the line of the line of travel of conveying means. In another embodiment the bridge crosses the line of the conveying means at an angle, this inclined location being particularly useful when the first progression of tooling is a staggered array of tools.

The conveying means may be a continuous loop of belt passing between the upper and lower tools of the first progression and returning under a bolster which supports the lower tools on the bed, in which case the bridge may be supported on the bolster.

The first progression of tools may be duplicated to a two lane system comprising two sets of first progression tools arranged in parallel but staggered array along the bed, both sets of tools being served by a single belt having parallel rows of apertures each to carry a component from one tool to the next in which case the bridge spans the belt.

In order to reduce the unsupported length of the bridge in a two lane system, one can, if desired, space the sets of tools apart and serve each set of tools with a single belt so that it is possible to locate a pillar between the belts to support the centre of the bridge. The pillar can provide support for a high load tab forming operation.

Various embodiments will now be described by way of example and with reference to the accompanying drawings in which:

BRIEF DESCRIPTION OF THE DRAWINGS

FIG. 3 is a diagram showing layout of first and second tool progressions;

FIGS. 4*a* and 4*b* show a side view and section of a bridge;

DESCRIPTION OF THE PREFERRED EMBODIMENTS

Figure 1:
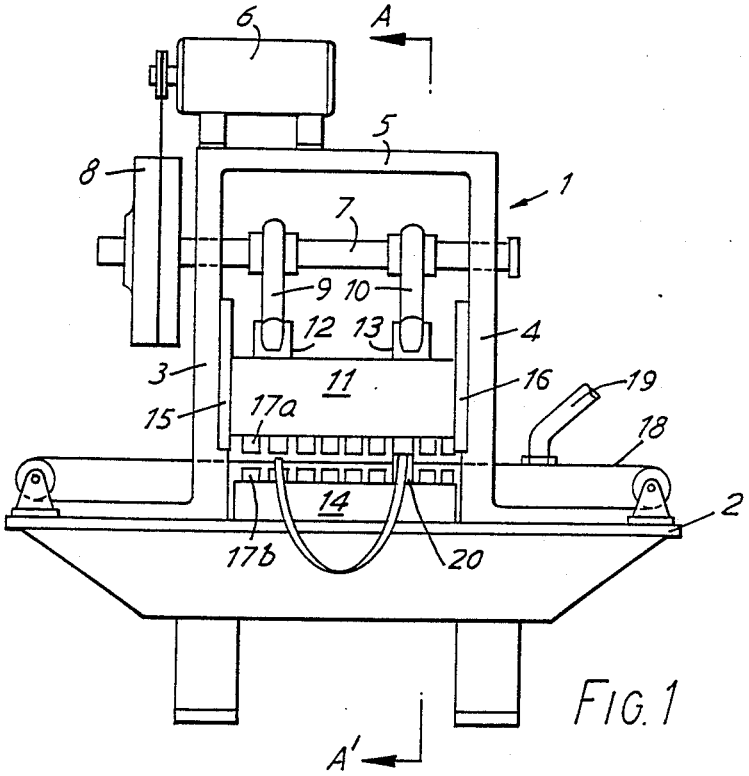
FIG. 1 is a side view of a simplified first embodiment of a press having first a first progression of tools arranged along the bed.

FIG. 1 shows a press having first and second progression tools to make can ends fitted with a ring pull, a first embodiment of the press 1 comprises a frame having a base 2, a pair of end walls 3,4 spaced apart and upstanding from the base, and a top plate 5 which supports a motor 6. A two throw crank shaft 7 supported for rotation by the end walls 3,4, spans the frame and at one end has a clutch/fly wheel 8, which is operably connected to the motor 6 by a drive belt. Connecting rods 9,10 connect the crank shaft to a ram 11 at respective pivotable knuckles 12, 13 so that rotation of the crank shaft moves the ram progressively towards and away from a bed 14 (which may include bolster and die shoe portions omitted for clarity). The ram is guided by guide bars 15,16 which are fixed to the frame walls 3,4. A first progression of tool pairs is arranged along the bed, each tool pair comprising an upper tool e.g. 17*a* fixed to the ram and a lower tool 17*b* fixed to the bed.

A continuous belt 18 receives can end shells from a delivery device 19 so that each shell is carried in an aperture in the belt from one tool pair to the next along the first progression of tool pairs. As drawn in FIG. 1 the shells are carried from right to left. After two preliminary forming operations by first progression tools the components pass under a bridge 20 which supports the lower tools of a second progression tool which makes pull tabs for subsequent fitting to the can end shell.

Figure 2:
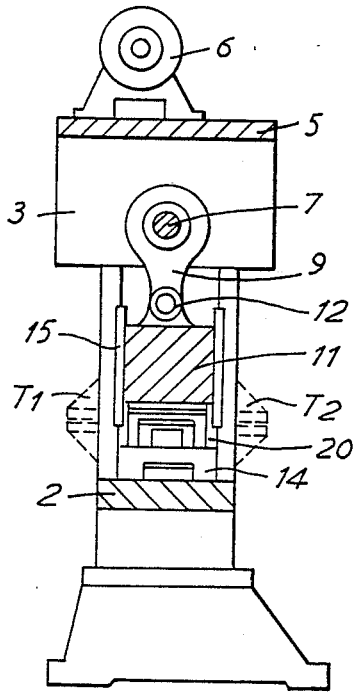
FIG. 2 is a side view of the press sectioned on line A—A[1] in FIG. 1.

FIG. 2 serves to explain why a bridge is necessary. As the crank shaft 7 rotates to urge the connecting rod, forward towards the ram 11 the top of the ram is pushed to the left to rub on the left guide 15. On the return stroke the connecting rod pulls the ram onto the guide bar; so the guide bars become worn. This wear becomes accentuated if an upper tab forming tool is fixed on the left side of the ram because the weight of the tool pulls the left side of the ram against the guide bar. As already explained in the introduction, the tab forming progression can be made in two halves. By mounting one half upper tool on the left of the ram and the other half of the tool on the right of the ram a state of static balance can be approached (consider the upper tool halves $T_1$,$T_2$ shown dashed in FIG. 2 which one would obviously expect to "hang" level when the crank is at bottom dead centre). However, it is in the nature of each tool operation in the forming of a pull tab to require a different load, e.g. blanking, folding, coining and towards the end of the progression certain flattening operations can give rise to relatively high loads as the tool pair closes so exerting a tilting force on the ram. Locating such operations distant from the centre line of the ram increases the tilting moment of force received by the guide bars. In order to minimise the off-centre moment of force arising as the tab forming tools work, we provide a strong bridge 20, under the ram 11, which spans the conveyor belt 18 and supports the lower tools of the tab forming progressions so permitting more work to be done under the ram area than is described in U.S. Pat. No. 4,568,230.

As shown in FIG. 1 a strip of tab material, having formed tabs therein, is looped and passed into a tool pair of the first progression at which a tab is fitted onto a rivet of a can end shell and staked to complete a finished can end. It will be noticed that the high combined load of tab forming is located adjacent the low load preliminary operations on the can end near the thrust of knuckle 13 and the high loads of scoring of the can and are under knuckle 12.

By way of a non limited example, FIG. 3 shows diagramatically each tool location of the tools that may be laid on the press of FIGS. 1 and 2 to convert a can end shell of 3.67" diameter drawn from tinplate 0.010" thick (0.25 mm) to a scored can end having a pull tab ring fixed in the scored area. Each tool pair is represented by a rectangle in which the tool function is named and an approximate workload indicated.

Reading FIG. 3 from top to bottom the second progression tool, which forms a pull tab from a strip of tinplate 0.014" thick, starts with "notch and pierce", and then "finger hole pierce", each requiring a low load of about 0.8 tons. Thereafter "lancing" and "rivet well forming" require higher loads of 1.7 and 1.8 tons respectively. Just before reaching the bridge 20 the rivet hole is pierced by application of a load of 0.3 tons.

On the bridge a precurling load of 2.3 tons is applied to the periphery of the ring pull tab and aperture. Beyond the bridge tab forming operations continue as shown in FIG. 3; notable amongst which are a "90° form" requiring 1.7 tons and "curling" which requires 2.8 ton. It will be noticed that the loads before the bridge roughly equate to the loads after the bridge and the weight of tool metal is symmetrically distributed across the centre line of the bed and ram.

Reading FIG. 3 from left to right, the shell conversion progression of tools starts with "bubble" forming at which a blister of metal of the can end is stretch formed ($1\frac{1}{2}$ tons); at a second tool pair the bubble is reformed (1 ton); the shells then pass under the bridge 20 to a third station called "button" at which the reformed bubble is shaped to the form of a hollow cylindrical rivet (load 2 ton). Therefore, there is an evenly distributed tool load under the con rod knuckle 13 quite near the ram guide 16.

Completion of the can end shell and staking of a pull tab to the rivet of the can end shell is performed under the other con rod knuckle 12.

As depicted, the total workload on con rod 12, is not quite equal to that on con rod 13. Equal loading, if desired, can be achieved by locating the bridge at a later position in the progression of shell forming tools, e.g. at the idle station as will be discussed with reference to embodiments described hereafter.

Figure 5:
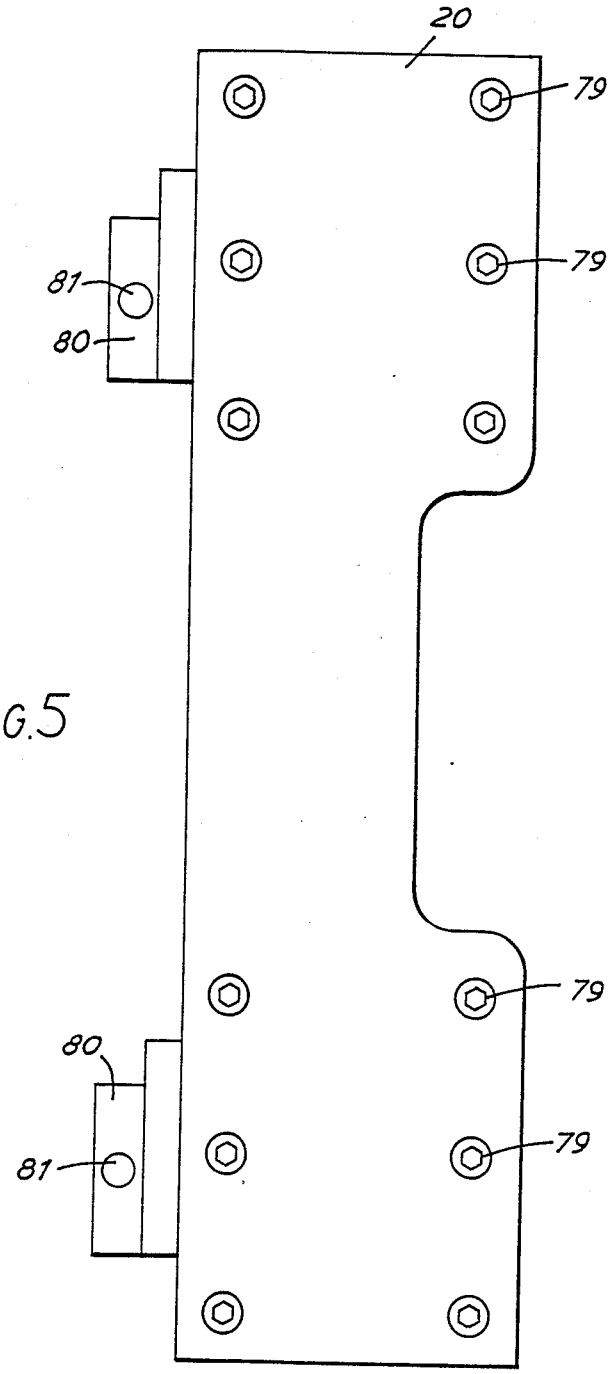
FIG. 5 is a plan view of a bridge and fixings.

FIG. 4*a* shows a bridge, supported in the manner of a simple beam, on support blocks 43. In order to support the lower tab forming tools in adequate alignment with the upper tab tools it is necessary to provide a bridge which will not deflect excessively when loaded. By way of a general example, a bridge was made of mild steel having a span length "l", a width "b" and thickness "d". As indicated in FIG. 4*b* the bridge may, if desired, have end portion of width "p" on the support blocks 43 as is shown in FIG. 5.

The deflection at the centre of the bridge per ton of load "W" applied at the centre of the bridge is expressed by $$\frac{W l^3}{48EI}$$

where E is Young's modulus (e.g. 30,000,000× by $10^6$ for mild steel) and I, the moment of inertia is $$\frac{bd^3}{3}.$$

For a mild steel bridge having width b=7"; span $l=11\frac{1}{4}$" and thickness "d"=2" the deflection is $12\times10^{-5}$ inches per ton. This order of deflection is tolerable for support of at least one of the tab forming tool wads and possibly several of them.

Figure 6:
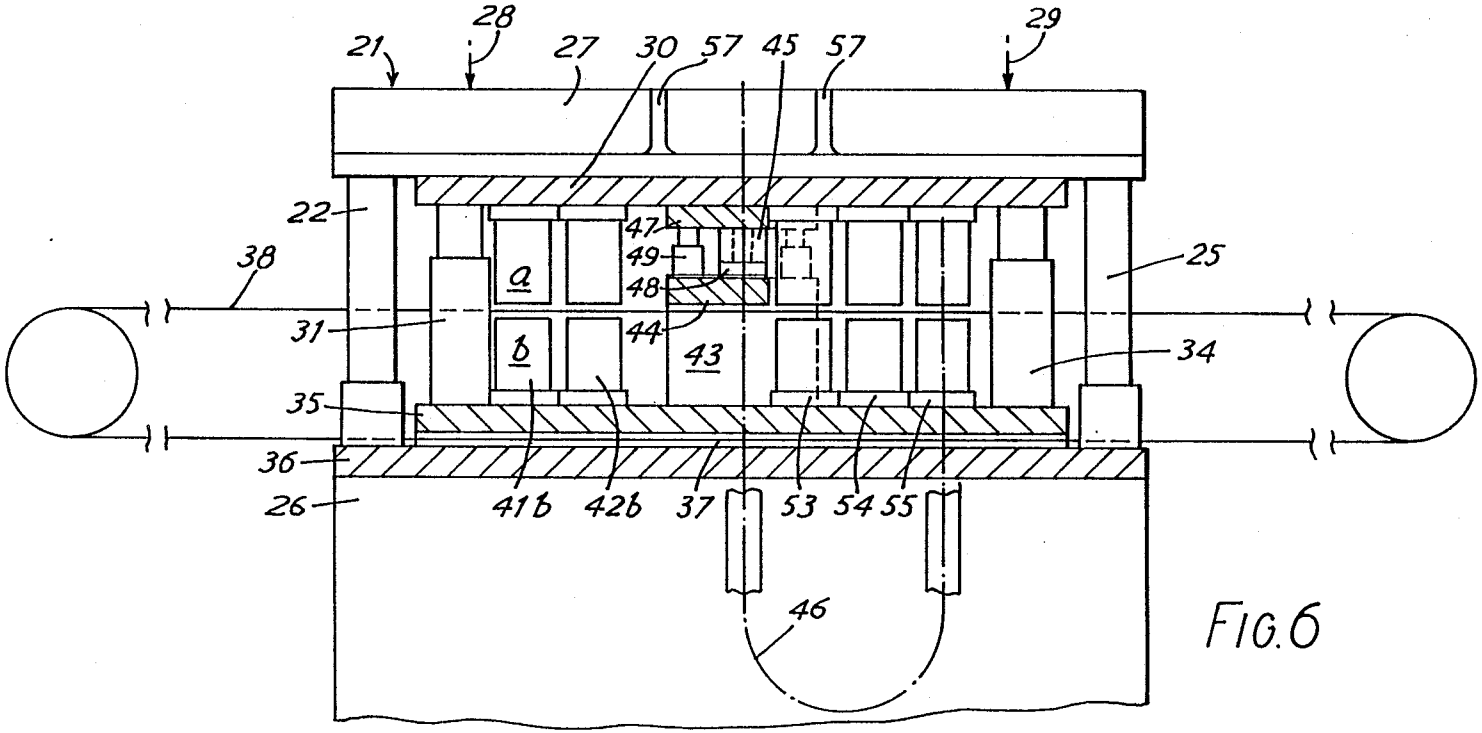
FIG. 6 is an enlarged fragmentary side view of a second embodiment of the press having guide pillars.
Figure 7:
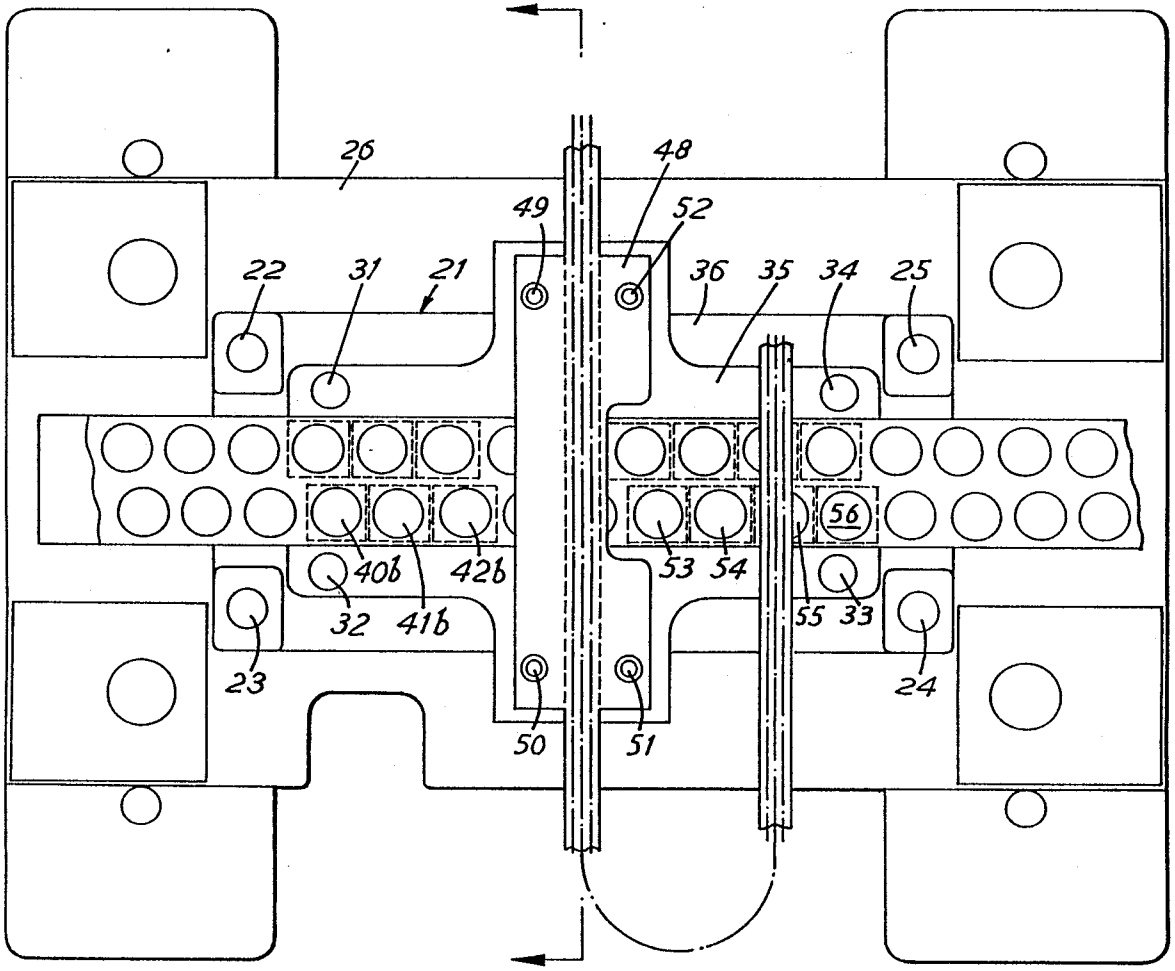
FIG. 7 is a plan view of the bed area of the press of FIG. 6.

The deflection at the centre of the beam can be reduced by firm fixing of the bridge to the support blocks. In FIG. 5 a bridge has a wide portion at each end which is fixed by six $\frac{1}{2}$" - 13 UNC socket head screws, such as 79, to a support block 43. The bridge has brackets 80 to accommodate locating pins 81 which locate each end of the bridge 20 and its support block accurately on the press bed, or lower die shoe, if one is used. FIGS. 6 and 7 show a second embodiment of the press 21 which has four guide posts 22,23,24,25, each rooted in the bed 26 and passing through the ram 27, to guide the ram on a reciprocating path towards and away from the bed. These guide posts 22,23,24,25 correspond in function to the guide bars 15,16 in the press of FIGS. 1 and 2. The location of connecting rods to the ram is shown by arrows 28,29. A punch plate 30 on the underside of the ram, four main die guide posts 31,32,33,34 and a lower die shoe 35 supported in an adjustable bolster 36 form a die set or subpress in which the first progression tool for forming can ends is located along the punch plate 30 and lower die shoe 35 from left to right as shown in FIG. 6. The bolster 36 is supported on the press bed 26 and defines an elongate passage 37 for return of a continuous belt 38 used to convey can end shells through the subpress. A double row of first progression of tool pairs is arranged along the bed (from left to right in FIGS. 6 and 7), each tool pair comprising an upper tool, generally denoted "a" fixed to the punch plate 30 and a lower tool, generally denoted "b" fixed to the lower die shoe 35. The first progression of tool pairs starts with a tool pair 40*a*, 40*b* (best seen in FIG. 7) that stretch forms a blister or "bubble" in the flat central panel of a can end. At a second tool pair, 41*a*, 41*b*, the bubble is reformed to a taller narrower shape and at a third station 42*a*, 42*b*, the reformed bubble is blocked to a hollow cylindrical rivet shape closed at one end. To the right of this third tool pair 42*a*, 42*b* (as shown in FIGS. 6 and 7), there is a gap in the first progression of tools. Support blocks 43 in the gap support a bridge 44 which spans the conveyor belt 38 and supports lower members of a second progression of tool pairs indicated at 45 which progressively form a pull tab from a strip of metal 46. Upper tools of the second progression are either incorporated in or fixed to a tab tool punch plate 47 which is engaged with the underside of the ram as will be described by reference to FIGS. 5 and 6. If the second tool progression is so long that it is wider than the ram, the ram is provided with webs or buttresses 57 to support it, as shown in FIG. 6. Lower tools of the second progression are supported by tab tool die shoe 48. Four pillars, 49,50,51,52 (best seen in FIG. 4) extend between the tab tool punch plate 47 and tab tool die shoe 48 to complete a subpress in which the second progression of tools is operably aligned. At least one tool pair of the second progression tool is located on the bridge over the conveyor belt.

To the right of the bridge (as shown in FIGS. 6 and 7) various further tool pairs of the first progression complete formation of the can end shell, for example, scoring 53, panelling 54. Thereafter the strip of metal 46 emerging from the second progression tool, bearing completed pull tabs, is fed into the first progression tooling at a tool pair 55 adapted to locate a pull tab on each can end and stake the rivet to fix the pull tab on the can end. At a final station 56 the present or absence of a pull tab on the can end is detected.

In FIG. 7 it will be seen that the first progression tooling is in the form of two rows of tool pairs arranged in parallel and staggered array along the lower die shoe. The tool pairs are all served by a single conveyor belt 38 having an array of apertures to match the tool pair layout.

In FIG. 7 the bridge 44 is located on the centre line from front to back of the lower die shoe 35 and bolster 36 so the weight of metal of the tools and lower die shoe 35 are symmetrically distributed on the bolster 36 and bed 26. Similar symmetrical distribution of the tool and punch plates' weight is achieved on the ram 27, and the whole area of the underside of the ram is being used for useful work.

Figure 8:
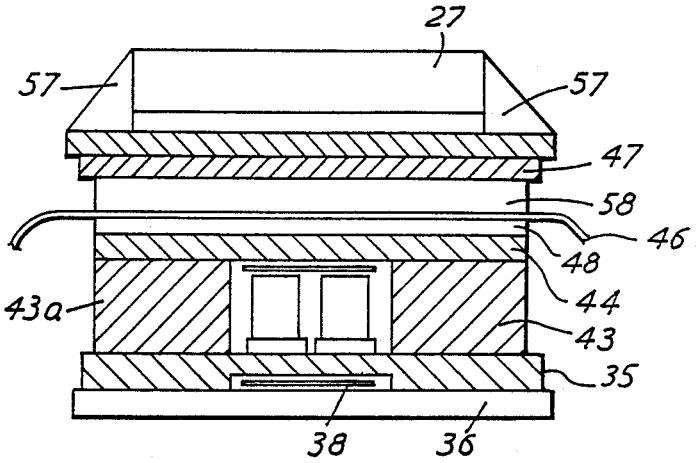
FIG. 8 is a sectioned side view showing the bridge of FIGS. 6 and 7 in detail.
Figure 9:
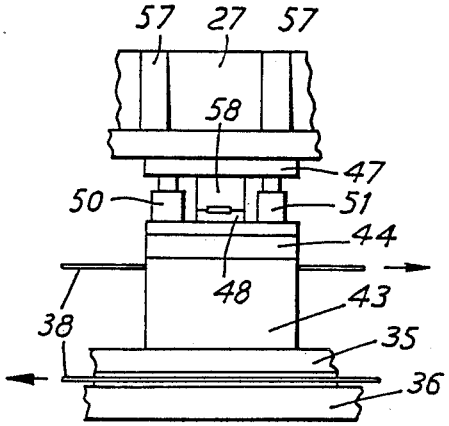
FIG. 9 is an end view of the bridge of FIG. 5.

Referring to FIGS. 8 and 9 it will be seen that the bridge comprises a first support block 43, a second support block 43*a* spaced apart from the first support block, and a beam member 44, resting on the support blocks. The support blocks 43,43*a* are tall enough to hold the beam above the conveyor belt 38 so that can ends in the conveyor belt pass under the bridge undisturbed. The support blocks 43 are supported by, and fixed to the lower die shoe 35 by fixing (not shown). Typically, the beam member 44 of this simple example is about two inches thick and made of mild steel. If however, the loads on the bridge in the second progression are high enough to cause bending of mild steel, an alloy steel of high strength may be used. If desired the beam member may be shaped to cooperate with support blocks in the forms commonly used in the bridge art so that the central span of the beam member acts in the manner of a key stone in a masonry arch.

As shown in FIGS. 8 and 9 the lower tooling of the second progression tooling 48 is laid upon the bridge or die shoe member 44. However, if desired, the lower tooling may rest on a separate beam member made of a single piece of tool metal to act as a bridge.

In FIG. 8 the tooling 45 is longer than the width of the ram 27 so buttresses 57 have been provided to support the excess length of the upper tools 58 top die shoe and deliver thrust to the lower tools.

Figure 10:
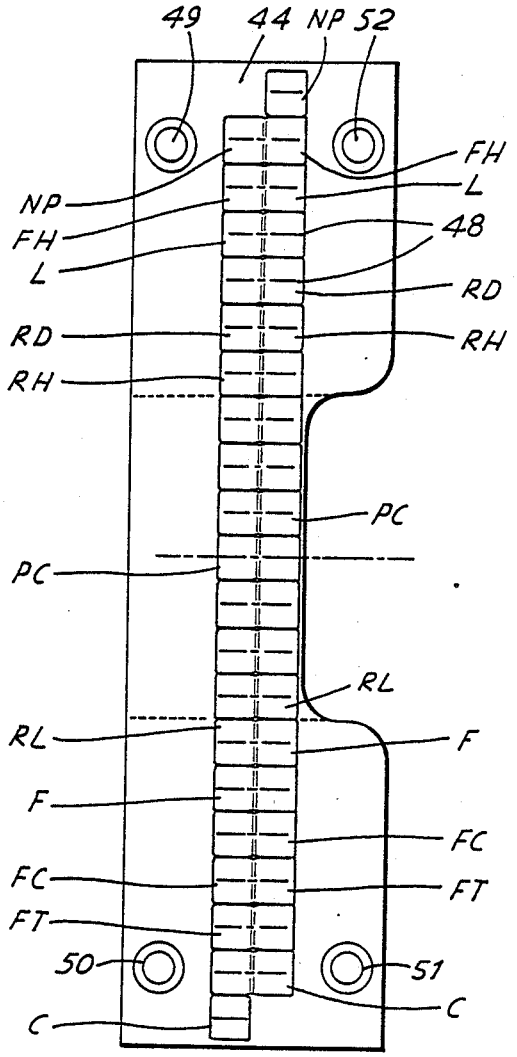
FIG. 10 is a plan view of the bridge enlarged to show schematically the layout of two lanes of tab forming tools on the bridge.

FIG. 10 shows a plan view of the bridge in which the lower tool of each tool pair is shown as a rectangle defining the area of the lower tool. In FIG. 10 the second progression comprises two progression tools arranged in parallel and staggered array, and extending along a central zone of the bridge. The bridge/die shoe 44, are cut away at the centre to permit location of a first progression operation in the cut away recess, as shown in FIG. 3. The four guide pillars 49,50,52,52, can be seen at the corners of the bridge and or shoe 44.

Reading FIG. 10 from top,(or start) to bottom, the operations in each progression are notch and pierce, finger hole pierce, lance, rivet well draw, rivet hole pierce (all supported on the first support block); precurl (supported on the bridge over the conveyor); and rivet well lance, 90° form, final curl, form tab tip, crank (supported on the second block). The forming of the final curl requires a relatively high load so, as will be understood from FIG. 7, this cranking load exerts a tilting moment on the tools/ram at a significant distance from the centre line of the ram.

The early operations 40,41,42, on the can end shell, are quite low in load, but, shortly after the bridge, scoring takes place at tool pair 53 which requires a high load at a location distant from the line of thrust of the connecting rods which means the total of tab tool loads and scoring is all at roughly the centre of the ram 27, so it appears that there is advantage in locating the second progression tooling and bridge a location earlier in the first progression layout to separate the high loads.

Figure 11:
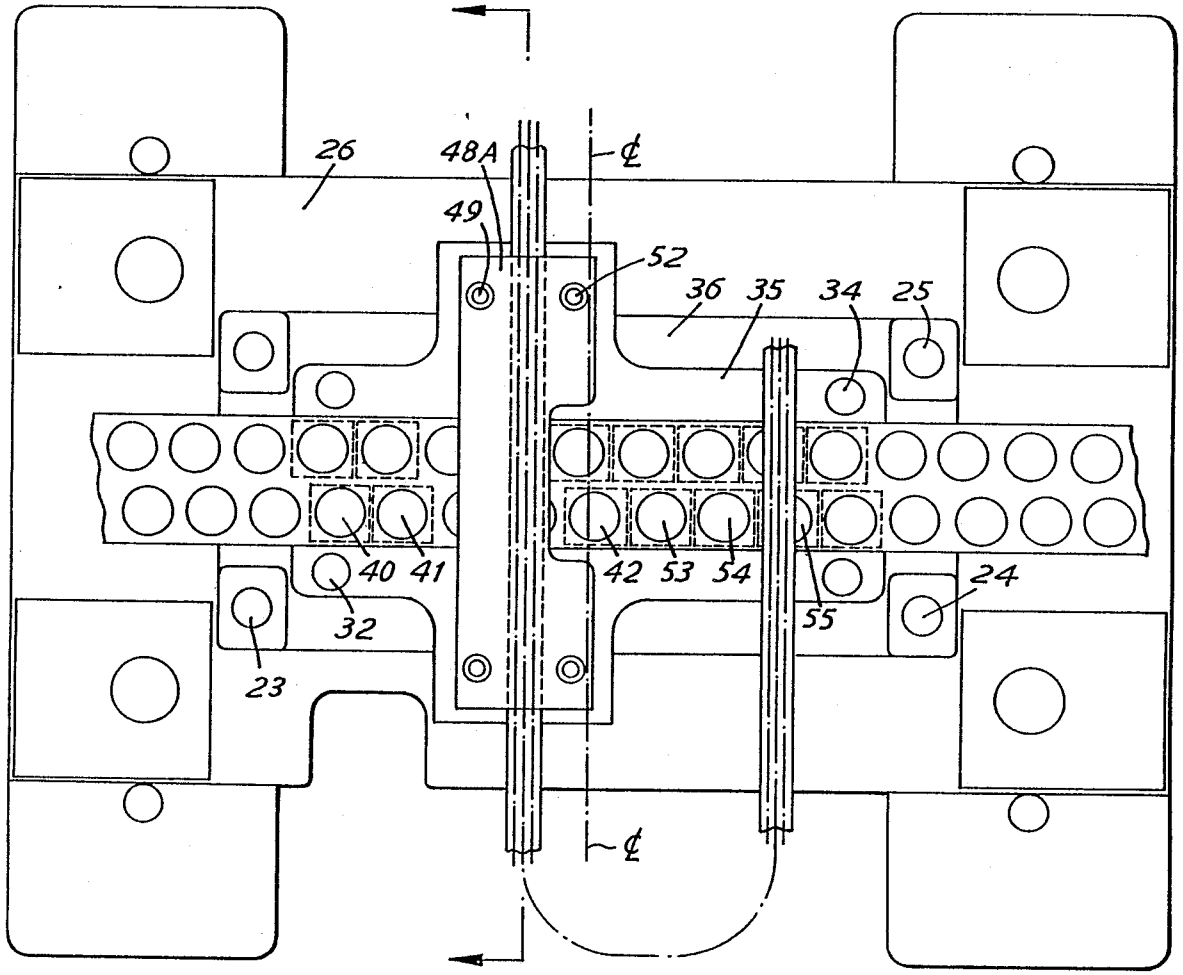
FIG. 11 is a plan view of a modified form of the embodiment of FIG. 7.

FIG. 11 shows a modified form of the layout shown in FIG. 7 so that like functioning parts are denoted by the same part numbers. In FIG. 11 the bridge 48A is located one tool station left of the front to back centre line C/L of the lower die shoe 35 to show that the working loads of each progression of tools can be distributed on the ram and lower die shoe to achieve balanced loading on the ram and lower die shoe.

Figure 12:
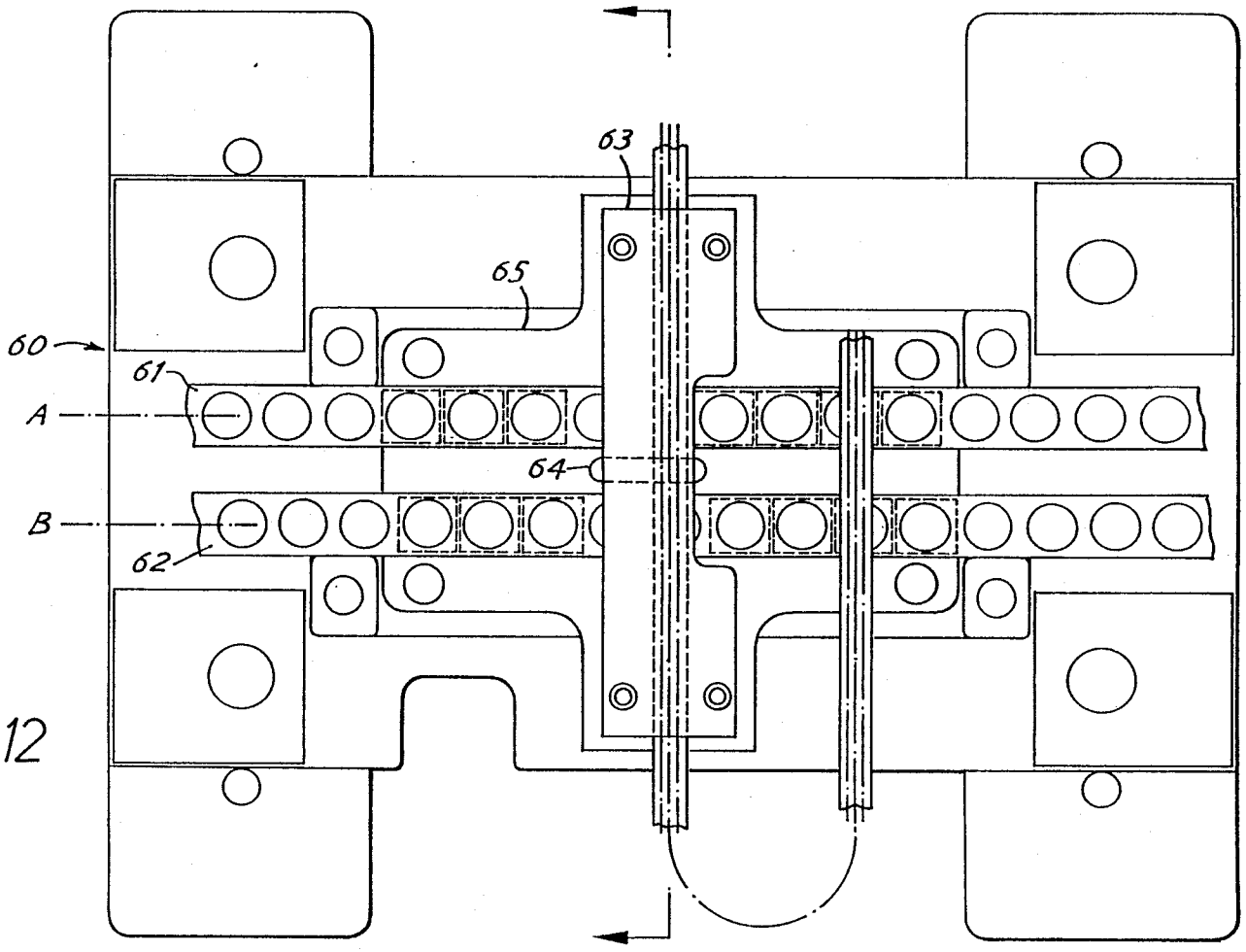
FIG. 12 is a plan view of the bed area of a third embodiment of the press having two lanes of first progression tools spaced apart.

FIG. 12 shows a third embodiment of the press 60 in which the tool loading is spread by separating the two lanes A,B of first progression tooling apart and serving each lane of tool pairs with a separate conveyor belt 61,62. Thus the tool loads arising from each lane of tooling tend to exert balanced forces on the ram. A further advantage arising from separation of the two lanes of first progression tooling is that it permits each lane to be provided with a series of tools to work on, for example, a different diameter of can end. Out-of-balance forces will not be serious because the rivet scoring and staking loads are substantially the same for a wide range of can end diameters.

A disadvantage arising from the separated lanes A,B of the press 60 of FIG. 11 is that the length of bridge over the conveyors 61,62, is longer than in the embodiment of FIGS. 3 to 6. If however, this extra length gives rise to bending of the bridge 63, a pillar 64 to support the bridge may be rooted in the lower die shoe 65 and extend upwards between the belts to support a middle portion of the bridge 63. The bridge area over such a pillar is a good place to locate a high load tool pair of the second progression tools.

Figure 13:
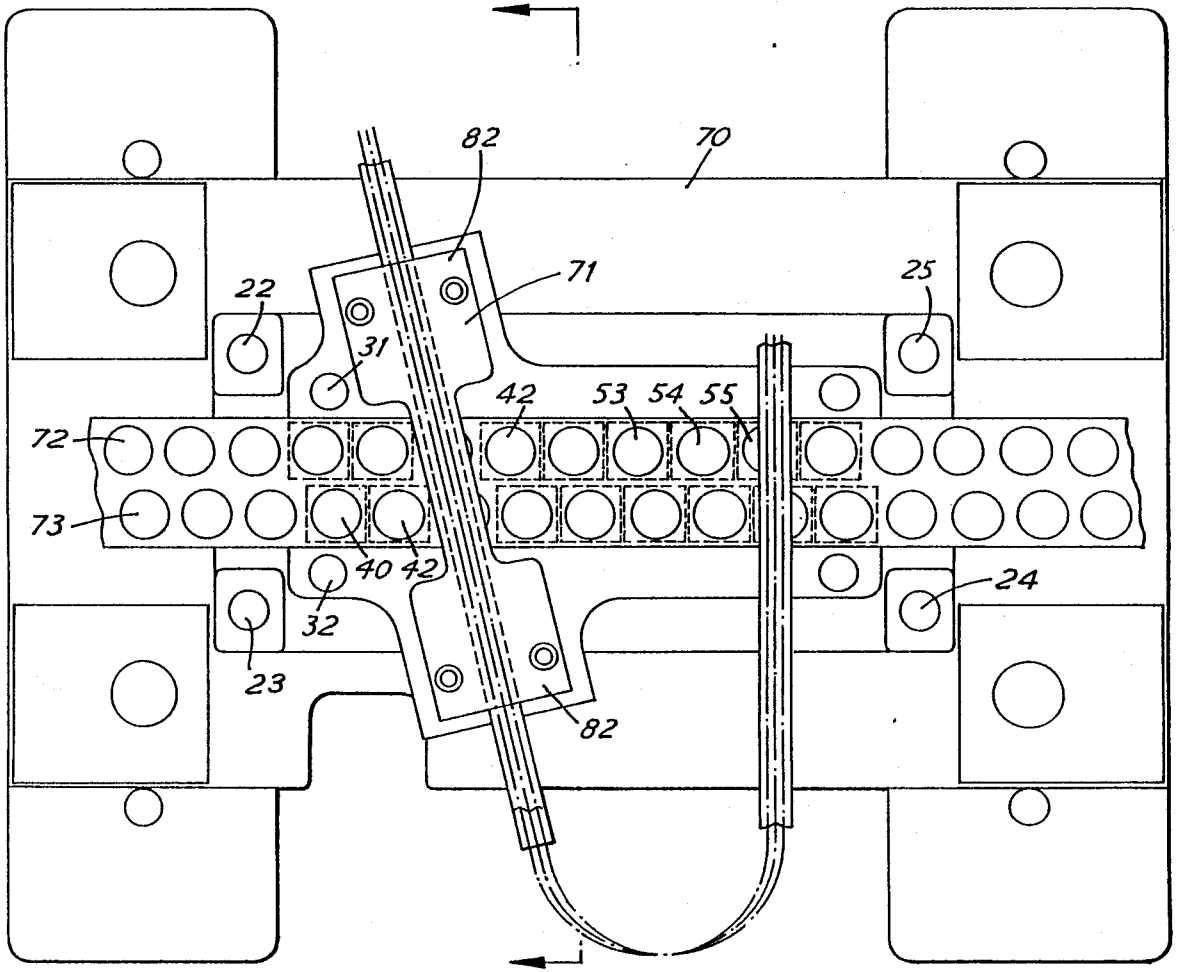
FIG. 13 is a plan view of the bed area of a fourth embodiment of the press having two lanes of first progression tools served by a single conveyor belt spanned by a skew bridge.

It will be noticed that in FIGS. 7, 11 and 12 the bridge 44 intrudes upon four tool "spaces" of the first progression tooling as it crosses the conveyor 38 or conveyors 61,62 at right angles. FIGS. 13, 15*a* and 15*b* show a fourth embodiment of the press 70, in which a modified bridge 71 crosses at an angle, a staggered array of two lanes of first progression tooling supported on a die shoe 71 modified to support the bridge which occupies only one tool pair position in each lane 72,73. The bridge supports a double row of second progression tooling to make two pull tabs simultaneously.

In FIG. 13 each first progression tool starts with a low load bubble raising operation and continues with a bubble reforming operation after which there is room for the bridge and its pillar guide flanges 82 to be located, as shown, without inconvenient proximity to the main guide posts 31,32. Beyond the bridge 71 the first progression tools include button blocking 42 and an idle station so that the first four tool pairs 40,41,42, of the first progression tools and double row of tab forming tools on the bridge 71 present a group of work load to the left hand knuckle of the ram (shown in FIG. 6) which receives guidance from the main guide posts 22,23 nearby. At the other end of the bed the relatively high load work of scoring 53 and staking 55 of a tab to each can end is done under the right hand knuckle of the ram which receives guidance from the right hand pair of main guide posts 24,25, so the tilting leverage of the work loads on the ram 27 is minimised and the guide posts suffer less out of line forces to cause premature wear.

Figure 14:
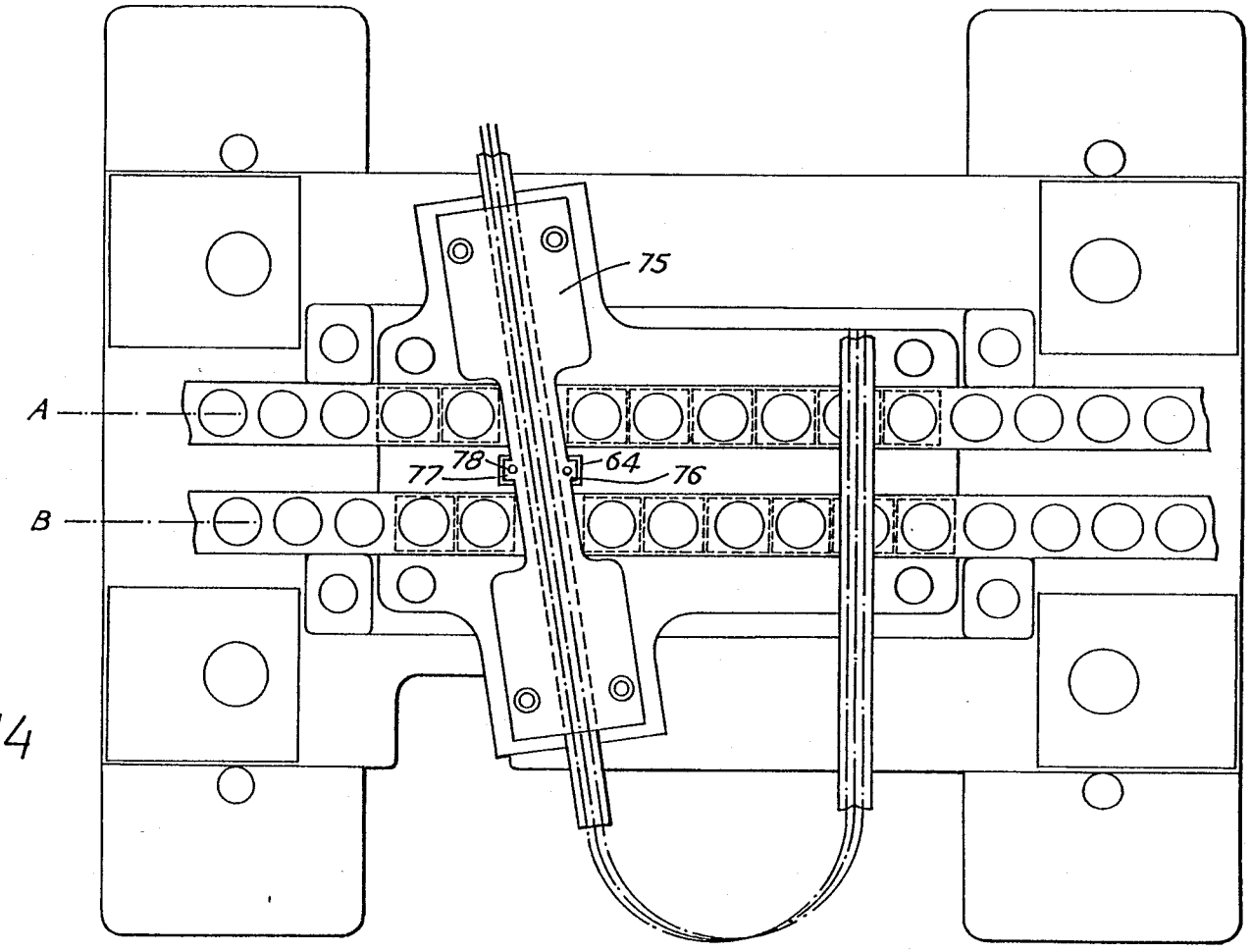
FIG. 14 is a plan view of the bed area of a fifth embodiment of the press having two lanes of first progression tools each served by a separate belt, the belts being spanned by a skew bridge supported by a pillar between the belts.

It is inevitable that the span of the skew bridge 71 of FIG. 13 is longer than that of the bridges extending straight across the conveyor belts 72, 73. However, referring to FIG. 14, it will be seen that, by adopting the two separated rows A,B of first progression tools (already discussed with reference to FIG. 12), it is possible to insert a pillar 64, between the rows of first progression tools to support the centre of the lower bridge. If desired the central portion of the bridge may be provided with opposed flanges 76,77 to spread the load on the pillar and restrain the centre of the bridge from twisting. Cap screws 78 penetrating these opposed flanges are used to hold the flanges on the pillar and the pillar onto the lower die shoe (omitted from FIG. 12*a* for clarity).

Figure 15:
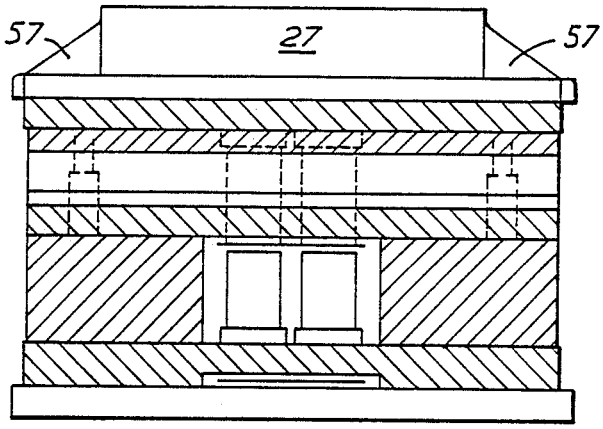
FIGS. 15*a* and *b* are sectioned side and plan views of the bridge of FIG. 13, and FIGS. 16*a* and *b* are sectioned side and plan views of the bridge of FIGS. 14 and 12.
Figure 15:
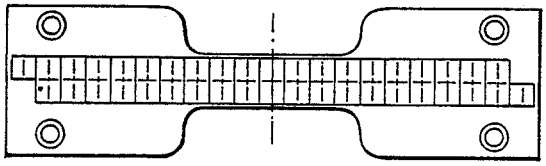
Figure 16:
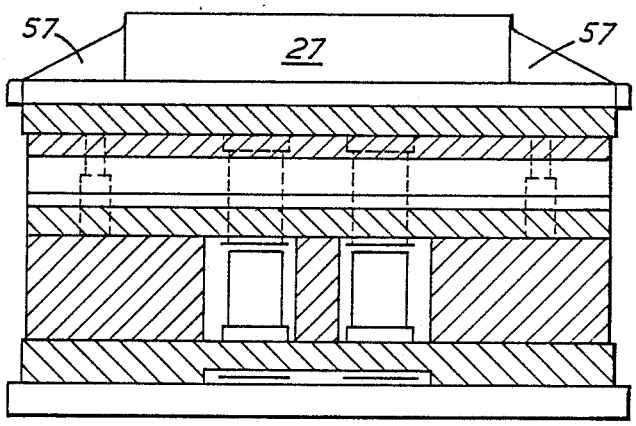
Figure 16:
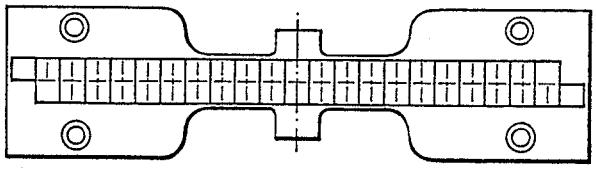

Referring to FIGS. 15*a*,*b* and 16*a*,*b* it will be seen that the second progression tooling in and over the bridge is longer than the width of the ram so that buttress webs 57 are provided to support the extremities of the supper tooling on the ram 27, in the manner already discussed with reference to FIGS. 8 and 9. In other respects the working of the bridges of FIGS. 13, 15 and 14, 16 is similar to that previously described with reference to FIGS. 8, 9 and 10.

We claim:

1. An improvement in a press of the type including a bed and a ram, means for reciprocating the ram relative to the bed, a first progression of tool pairs arranged along the bed, said first progression of tool pairs each including an upper tool carried by the ram and a lower tool carried by the bed, conveying means for conveying a first component along a first path of travel from an upstream position to a downstream position along said first progression of tool pairs, a second progression of tools pairs, said second progression of tool pairs each including an upper tool carried by the ram and a lower tool cooperative therewith, means for defining a second path of travel for a second component from an upstream position to a downstream position, said second path of travel having an upstream path portion and a downstream path portion each in traversing relationship to said first path of travel and defining therewith respective upstream traversing and downstream traversing positions, means at said downstream traversing position for uniting said first and second components, the improvement comprising bridge means at said upstream traversing portion spanning said first path of travel and supported by said bed for supporting at least one of said cooperative lower tools whereby, upon each reciprocation of the ram, work is performed upon a second component between said at least one cooperative lower tool and the associated upper tool thereof carried by the ram.

2. The improvement in the press as defined in claim 1 wherein said second path of travel upstream and downstream path portions are generally in parallel relationship to each other.

3. The improvement in the press as defined in claim 1 wherein at least one of said second path of travel upstream and downstream path portions is generally normal to said first path of travel.

4. The improvement in the press as defined in claim 1 wherein said second path of travel downstream path portion is generally normal to said first path of travel.

5. The improvement in the press as defined in claim 1 wherein said second path of travel upstream path portion is other than normal to said first path of travel.

6. The improvement in the press as defined in claim 1 wherein the ram includes a centerline disposed generally in transverse relationship to said first path of travel, and said bridge means crosses said conveying means offset from said centerline in the upstream direction of said first path of travel.

7. The improvement in the press as defined in claim 1 wherein said ram includes a centerline disposed generally in transverse relationship to said first path of travel, and said second path of travel upstream path portion crosses said conveying means offset from said centerline in the upstream direction of said first path of travel.

8. The improvement in the press as defined in claim 1 wherein said ram includes a centerline disposed generally in transverse relationship to said first path of travel, said second path of travel upstream path portion crosses said conveying means offset from said centerline in the upstream direction of said first path of travel, and said bridge means crosses said conveying means offset from said centerline in he upstream direction of said first path of travel.

9. The improvement in the press as defined in claim 1 wherein the first progression of tools pairs includes a bubble raising station, a bubble reforming station and a rivet forming station; and the bridge means crosses the conveying means between the reforming station and the rivet forming station.

10. The improvement in the press as defined in claim 1 wherein the first progression of tool pairs includes two sets of first progression tools arranged in parallel and staggered array along the first path of travel, the conveying means is a continuous belt having an array of apertures for carrying each first component between and along the first progression tool pairs, and the bridge means spans the belt.

11. The improvement in the press as defined in claim 1 wherein the first progression of tool pairs includes two rows of first progression spaced apart tool pairs, said conveying means conveys first components to said two rows, said conveying means are a pair of conveyors, and support means between said pair of conveyors for supporting said bridge means above said pair of conveyors.

12. The improvement in the press as defined in claim 1 wherein said conveying means are a pair of spaced conveyors, and support means between said pair of conveyors for supporting said bridge means above said pair of conveyors.

13. The improvement in the press as defined in claim 1 wherein said conveying means are a pair of side-by-side laterally spaced conveyors, and support means between said pair of conveyors for supporting said bridge means above said pair of conveyors.

14. The improvement in the press as defined in claim 1 wherein said conveying means are a pair of laterally spaced side-by-side conveyors, support means between said pair of conveyors and beneath said bridge means for supporting said bridge means above said pair of conveyors, and at least one tool pair of said second progression of tool pairs is located over said support means.

15. The improvement in the press as defined in claim 1 wherein said conveying means are a pair of laterally spaced side-by-side conveyors, support means between said pair of conveyors and beneath said bridge means for supporting said bridge means above said pair of conveyors, and said at least one cooperative lower tool is located over said support means.

16. The improvement in the press as defined in claim 6 wherein said second path of travel upstream and downstream path portions are generally in parallel relationship to each other.

17. The improvement in the press as defined in claim 6 wherein at least one of said second path of travel upstream and downstream path portions is generally normal to said first path of travel.

18. The improvement in the press as defined in claim 6 wherein said second path of travel downstream path portion is generally normal to said first path of travel.

19. The improvement in the press as defined in claim 6 wherein said second path of travel upstream path portion is other than normal to said first path of travel.

20. The improvement in the press as defined in claim 6 wherein the first progression of tool pairs includes two sets of first progression tools arranged in parallel and staggered array along the first path of travel, the conveying means is a continuous belt having an array of apertures for carrying each first component between and along the first progression tool pairs, and the bridge means spans the belt.

21. The improvement in the press as defined in claim 6 wherein the first progression of tool pairs includes two rows of first progression spaced apart tool pairs, said conveying means conveys first components to said tool pairs, said conveying means are a pair of conveyors, and support means between said pair of conveyors for supporting said bridge means above said pair of conveyors.

22. The improvement in the press as defined in claim 6 wherein said conveying means are a pair of spaced conveyors, and support means between said pair of conveyors for supporting said bridge means above said pair of conveyors.

23. The improvement in the press as defined in claim 6 wherein said conveying means are a pair of side-by-side laterally spaced conveyors, and support means between said pair of conveyors for supporting said bridge means above said pair of conveyors.

24. The improvement in the press as defined in claim 6 wherein said conveying means are a pair of laterally spaced side-by-side conveyors, support means between said pair of conveyors and beneath said bridge means for supporting said bridge means above said pair of conveyors, and at least one tool pair of said second progression of tool pairs is located over said support means.

25. The improvement in the press as defined in claim 6 wherein said conveying means are a pair of laterally spaced side-by-side conveyors, support means between said pair of conveyors and beneath said bridge means for supporting said bridge means above said pair of conveyors, and said at least one cooperative lower tool is located over said support means.

26. The improvement in the press as defined in claim 7 wherein the first progression of tool pairs includes two sets of first progression tools arranged in parallel and staggered array along the first path of travel, the conveying means is a continuous belt having an array of apertures for carrying each first component between and along the first progression tool pairs, and the bridge means spans the belt.

27. The improvement in the press as defined in claim 7 wherein the first progression of tool pairs includes two rows of first progression spaced apart tool pairs, said conveying means conveys first components to said two rows, said conveying means are a pair of conveyors, and support means between said pair of conveyors for supporting said bridge means above said pair of conveyors.

28. The improvement in the press as defined in claim 7 wherein said conveying means are a pair of spaced conveyors, and support means between said pair of conveyors for supporting said bridge means above said pair of conveyors.

29. The improvement in the press as defined in claim 7 wherein said conveying means are a pair of side-by-side laterally spaced conveyors, and support means between said pair of conveyors for supporting said bridge means above said pair of conveyors.

30. The improvement in the press as defined in claim 7 wherein said conveying means are a pair of laterally spaced side-by-side conveyors, support means between said pair of conveyors and beneath said bridge means for supporting said bridge means above said pair of conveyors, and at least one tool pair of said second progression of tool pairs is located over said support means.

31. The improvement in the press as defined in claim 7 wherein said conveying means are a pair of laterally spaced side-by-side conveyors, support means between said pair of conveyors and beneath said bridge means for supporting said bridge means above said pair of conveyors, and said at least one cooperative lower tool is located over said support means.

32. The improvement in the press as defined in claim 8 wherein the first progression of tool parts includes two sets of first progression tools arranged in parallel and staggered array along the first path of travel, the conveying means is a continuous belt having an array of apertures for carrying each first component between and along the first progression tool pairs, and the bridge means spans the belt.

33. The improvement in the press as defined in claim 8 wherein the first progression of tool pairs includes two rows of first progression spaced apart tool pairs, said conveying means conveys first components to said two rows, said conveying means are a pair of conveyors, and support means between said pair of conveyors for supporting said bridge means above said pair of conveyors.

34. The improvement in the press as defined in claim 8 wherein said conveying means are a pair of spaced conveyors, and support means between said pair of conveyors for supporting said bridge means above said pair of conveyors.

35. The improvement in the press as defined in claim 8 wherein said conveying means are a pair of side-by-side laterally spaced conveyors, and support means between said pair of conveyors for supporting said bridge means above said pair of conveyors.

36. The improvement in the press as defined in claim 8 wherein said conveying means are a pair of laterally spaced side-by-side conveyors, support means between said pair of conveyors and beneath said bridge means for supporting said bridge means above said pair of conveyors, and at least one tool pair of said second progression of tool pairs is located over said support means.

37. The improvement in the press as defined in claim 8 wherein said conveyor means are a pair of laterally spaced side-by-side conveyors, support means between said pair of conveyors and beneath said bridge means for supporting said bridge means above said pair of conveyors, and said at least one cooperative lower tool is located over said support means.

* * * * *